US008899142B1

(12) United States Patent
Cassels

(10) Patent No.: US 8,899,142 B1
(45) **Date of Patent: *Dec. 2, 2014**

(54) BOLT CARRIER ASSEMBLY

(71) Applicant: Charles B. Cassels, New Smyrna, FL (US)

(72) Inventor: Charles B. Cassels, New Smyrna, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/189,057

(22) Filed: Feb. 25, 2014

Related U.S. Application Data

(63) Continuation of application No. 12/909,278, filed on Oct. 21, 2010, now Pat. No. 8,689,672.

(60) Provisional application No. 61/254,403, filed on Oct. 23, 2009, provisional application No. 61/322,536, filed on Apr. 9, 2010.

(51) Int. Cl.
*F41A 3/78* (2006.01)

(52) U.S. Cl.
CPC ..... *F41A 3/78* (2013.01)
USPC ..... 89/198; 89/191.01; 42/69.02

(58) Field of Classification Search
CPC ..... F41A 3/00; F41A 3/30; F41A 3/78; F41A 5/00; F41A 5/18; F41A 5/26; F41A 5/28
USPC ..... 89/191.01, 198; 42/69.02
See application file for complete search history.

(56) References Cited

U.S. PATENT DOCUMENTS

| | | | |
|---|---|---|---|
| 6,971,202 | B2 | 12/2005 | Bender |
| 7,461,581 | B2 | 12/2008 | Leitner-Wise |
| 8,307,750 | B2 | 11/2012 | Vuksanovich et al. |
| 8,375,616 | B2 | 2/2013 | Gomez et al. |
| 8,387,513 | B2 | 3/2013 | Gomez et al. |
| 2005/0223613 | A1 | 10/2005 | Bender |
| 2009/0031607 | A1 | 2/2009 | Robinson et al. |
| 2012/0131835 | A1 | 5/2012 | Barrett et al. |
| 2012/0137869 | A1 | 6/2012 | Gomez et al. |
| 2012/0152105 | A1 | 6/2012 | Gomez et al. |

*Primary Examiner* — Jonathan C Weber

(74) *Attorney, Agent, or Firm* — Carter DeLuca Farrell & Schmidt LLP

(57) ABSTRACT

A convertible gas piston conversion system for the AR-15, AR-10, or their variant rifle platforms is provided to convert the platform from a direct impingement gas system to a piston driven operating system. The conversion system includes a gas block having a barrel bore and two piston cylinder bores one on either side of the gas block. One of the piston cylinder bores is for utilization of the AR-15 rifle and the other of the piston cylinder bores is for utilization of the AR-10 rifle, making this piston system convertible for either the AR-15, AR-10, or any of their variant rifle platforms. A piston cylinder is inserted into the gas block via the piston cylinder bore and a piston is actuated inside the piston cylinder to cycle the rifle. A connecting link is coupled between the piston and an op-rod making the gas systems length adjustable by simply replacing the connecting link. The op-rod acts directly upon a carrier lug to cycle the rifle and a compression spring or the like returns the piston back into the battery within the piston cylinder. An op-rod bushing guides the op-rod throughout travel. A bolt carrier includes a lug and an anti tilt/anti wear device. The bolt carrier provides a lug for the op-rod to impinge upon to cycle the rifle. The anti tilt/anti wear bolt carrier device installs into the rear of the bolt carrier to minimize damage and wear to the buffer tube and upper receiver from a condition identified as carrier tilt.

20 Claims, 13 Drawing Sheets

FIGURE 13C

BOLT CARRIER ASSEMBLY

CROSS-REFERENCE TO RELATED APPLICATION

This application is a continuation of U.S. application Ser. No. 12/909,278, filed Oct. 21, 2010, which claims the benefit of and priority to U.S. provisional application Ser. Nos. 61/254,403, filed Oct. 23, 2009 and 61/322,536, filed Apr. 9, 2010, the entirety of each of which is hereby incorporated herein by reference.

BACKGROUND

1. Technical Field

The present disclosure relates generally to an improved impingement system for rifles and more particularly to an improved piston operating impingement system and anti-wear bolt carrier for use with AR-15 and AR-10 rifles, as well as other related rifle platforms, e.g., the M4 and M16 rifles.

2. Description of the Related Art

Replacing the AR-15 and AR-10 OEM impingement system is not a new concept. Early on it was recognized in the industry that the exhausting of discharged gases into a bolt carrier and upper receiver of a rifle caused excessive amounts of heat and debris to be deposited in the action of the rifle causing parts to prematurely wear and become less reliable. Because of these issues many attempts have been made to replace the OEM impingement system with a reliable, cooler, cleaner, and lower maintenance operating system.

The obvious disadvantage of the OEM impingement system is that its operating system requires the discharging of hot, dirty gases from the barrel to be routed through the bolt carrier to cycle the rifle's action. The heat and debris deposited into the rifles action is essentially blown dry by subsequent firing, removing lubricant and leaving only heat and debris behind causing the rifle to become less reliable. Furthermore, the heat and baked on debris causes excessive wear and fatigue of the rifles critical components.

Many systems have been developed to replace the OEM impingement system. Some require replacing major rifle components up to, and in some cases, including the upper receiver assembly. Others require a gunsmith for installation. These requirements are costly and unnecessary.

Some manufacturers have designed systems that do not require replacement of major rifle components or require a gunsmith for installation and, thus, provide an improvement over the OEM impingement system and previous systems. One such system is sold by Adams Arms and CMMG Inc. The problems with the existing systems are numerous. Existing systems are not capable of being used with both the AR-15 and AR-10 rifle platforms interchangeably. Existing systems also can not interchange between the various length gas systems without a costly replacement of their entire operating rod. Existing systems are limited by what ammunition they can fire and are not capable of having a low profile gas block.

Existing systems also have no solution for a condition known as carrier tilt, which results from the carrier being struck off axis by the operating rod causing the carrier to tilt downward at the rear and upward at the front. The downward tilt results in damage to the buffer tube, while the upward tilt results in excessive force and wear on the upper receiver. This damage may necessitate costly parts replacement.

What is needed and not heretofore provided by the existing art is a convertible gas piston conversion system for the AR-15 and AR-10 rifle platforms to replace the impingement system of the OEM rifle and improve on the existing piston systems. What is further needed is a piston system capable of being used interchangeably between the AR-15 and AR-10, a system that can interchange between various length gas systems without costly part replacement, a system that is efficient enough not to limit ammunition caliber selection, and a system that facilitates the use of a low profile gas block and a system that solves the carrier tilt problem.

SUMMARY

The present disclosure provides a new and improved piston conversion system for the AR-15 and AR-10 rifle platform, eliminating the drawback of the original impingement system by no longer requiring hot fouled discharge gases to enter the rifles action for cycling. The present disclosure provides a piston conversion system that works with the AR-15 as well as the AR-10 rifle platforms and has new and unique features that improve on the existing AR-15 systems and kits. The present disclosure also provides a piston conversion system that does not require major parts replacement or extensive modification to the existing AR-15 or AR-10 rifle platform. The present disclosure also provides a piston conversion system that can interchange between various length gas systems without costly part replacement. The present disclosure also provides a piston conversion system with an efficient enough gas system not to limit type ammunition or caliber selection. The present disclosure also provides a piston conversion system designed in such a way as to facilitate the use of a low profile gas block. The present disclosure also provides a new and unique way to solve the carrier tilt problem associated with AR-15 and AR-10 piston operated systems. All of these are improvements on the existing technologies and more benefits will become evident in the further discussion of the presently disclosed gas piston conversion system that follows.

A convertible gas piston conversion system for use with the AR-15, AR-10, and their variant rifle platforms to convert from a direct impingement gas system to a piston driven operating system comprises a gas block having two configurations. In one configuration, a Picatinny-type rail is or a low profile design gas block which allows the gas block to be concealed under a hand guard is provided. The gas block has a barrel bore and two piston cylinder bores on either end, one for utilization with the AR-15 rifle and the other for the AR-10 rifle. The barrel bore extends completely through the gas block and is substantially parallel to the piston cylinder. The barrel bore is configured to receive a barrel securely inserted therein and has an unrestricted aperture which is configured to receive a discharge gas from a gas port formed through the barrel proximate to the muzzle of the rifle. The aperture extends from the barrel bore to the piston cylinder bore and directs the discharge gas towards the piston cylinder bore. The gas block is secured to the barrel to prevent movement of the gas block relative to the barrel and is configured to hermetically transport the discharge gas from the barrel through the gas block and on into the piston cylinder bore. The piston cylinder bore has an opening toward the breech end of the rifle. A piston cylinder is inserted into the piston cylinder bore from the breech end and is secured within the piston cylinder bore. The piston cylinder has an unrestricted internal passage to receive the discharge gas being delivered hermetically from the aperture directly into the piston cylinder. A piston is inserted into the piston cylinder. The piston, a connecting link and an op-rod are referenced herein as an op-rod assembly is positioned between the piston cylinder bore and a bolt carrier. The bolt carrier is comprised of one piece with an impingement lug and fitted with an anti tilt/anti wear buffer device.

The bolt carrier is actuated upon by the op-rod assembly to cycle the rifle. The op-rod assembly is held inline forming one continuous assembly that extends from the piston cylinder to the bolt carrier. A first end of the op-rod assembly is coupled with the piston cylinder and a second end of the op-rod assembly is held within the upper receiver positioned to actuate the bolt carrier. An actuating means forms an actuation coupling between the piston cylinder and the op-rod assembly. The actuating means, which includes discharge gases from the rifle, imparts a kinetic energy on the op-rod assembly and permits the op-rod assembly to be moved linearly in a breechward direction. A biasing means urges the op-rod assembly towards the piston cylinder with an urging force and permits translational movement of the op-rod assembly when the urging force is exceeded by the force of the actuating means.

Upon the firing of a round, the pressurized discharged gas is diverted through the gas port of the barrel, the discharge gas then being transported through the gas port aperture, and delivered into the piston cylinder passage. The discharge gas effects the breechward motion of the op-rod assembly to cause a breechward translation of the bolt carrier, causing a fired cartridge to be ejected. After the actuating force is exhausted, the biasing means returns the op-rod assembly toward the piston cylinder returning the piston into battery for subsequent firing. Once the rifle has been cleared of ammunition, the piston system can be disassembled by removing the hand guards and breaking the op-rod assembly into its requisite components, i.e., the connecting link, the op-rod, and the piston. This can be easily accomplished by compressing the biasing means and removing the connecting link from between the piston and op-rod. The break down of the op-rod assembly into three major components allows the piston conversion system to be easily fitted to any length gas operating system by simply substituting a connecting link of appropriate length.

As discussed in the background, there are many limiting factors associated with the existing piston conversion systems. The following illustrates in detail six improvements that have been achieved by the present invention over the existing piston conversion systems. Each one will start with a detailed description of the improvement, how the present invention makes possible these improvements, and concludes with a description of the limiting factors associated with the existing systems and why they are incapable of such improvements.

1) Interchangeability between the AR-15 and AR-10 family of rifles is made possible by designing the gas block aperture and piston cylinder passage large enough to receive discharge gas unrestricted from the OEM barrel gas port, thus making full use of the available gas; the piston cylinder's exhaust gas ports were engineered specific in size and location to allow enough energy to transfer to cycle the rifle before expelling excess gas out the exhaust ports; the AR-15 and AR-10 pistons and piston cylinders had to be engineered with differing design and size specifications to ensure adequate energy would be generated to cycle reliable with either rifle; the gas block had to be of a specific size and have piston bores drill specific to accommodate both the AR-15 and AR-10 piston cylinders. The gas block, piston cylinder, and piston had to be designed to disassemble in a breechward direction to allow for the interchangeability of the AR-15 and AR-10 due to the AR-10 requiring a larger piston cylinder and piston. If the piston was required to disassemble through the gas block as is the case with existing systems it would require a gas block size that would exceed the size requirements of the standard AR-15 and AR-10 gas blocks making it incompatible with standard accessories. Because of the complexity and disassembly requirements of the existing systems they are not compatible with the AR-10. The existing systems require the unscrewing or rotating of gas plug type devices, and further require parts removal through the gas block. Because the AR-10 requires a larger piston to cycle reliably it is not possible to disassemble the AR-10 piston through the gas block without exceeding the size requirements of a standard AR-15 and AR-10 gas block thus making the existing systems incompatible with the AR-10.

2) The ability to interchange between various length gas systems without costly part replacement is made possible by using a segmented op-rod assembly including a piston at one end, an op-rod at the other separated by a removable connecting link that enables the system to be easily adapted to all the various gas system lengths by simply replacing connecting links of various lengths to match the rifles gas system length. This is not possible with the existing systems that use a one piece piston and op-rod assembly. These existing systems require a costly replacement of the entire piston and op-rod assembly to change between the various gas systems lengths.

3) A simpler and more efficient gas system that does not limit ammunition type and caliber selection is achieved by designing a system that can be disassembled by merely removing the piston from the piston cylinder. This means having fewer parts to remove for disassembly thereby having few part interfaces where discharge gas is bled off robbing the gas system of efficiency and thereby limiting ammunition type and caliber selection. The existing systems require the unscrewing or rotating of gas plug type devices, and then further require part removal through the gas block, all of which creates multiple part interfaces where discharge gas may be bled off robbing the gas system of efficiency and thereby limiting ammunition type and caliber selection.

4) A system designed in such a way as to facilitate the use of a low profile gas block is possible because the piston cylinder and corresponding parts do not run through the entire length of the gas block nor are they required to transverse the gas block to be removed, thus facilitating a lower gas block height not to exceed the height of the piston cylinder. The existing systems require the piston and associated parts to run through the entire length of the gas block for operating and disassembly. This necessitates a larger gas block excluding it from a low enough profile to be cancelled or hidden under a hand guard.

5) A bolt carrier with specific design characteristics provide an anti tilt/anti wear buffer device constructed from a polymer type material which is press fitted into the rear of the bolt carrier to mitigate damage and excessive wear to the upper receiver and buffer tube from a condition identified as carrier tilt. Carrier tilt is a condition caused by the op-rod assembly impinging upon the bolt carrier lug off axis creating a downward and rearward thrusting force at the carrier's rear, as well as an upward and rearward thrusting force at the carrier's forward end. The downward thrusting force causes a collision between the bolt carrier and buffer tube, resulting in excessive wear and damage to the buffer tube. The upward thrusting force causes the carrier to move upwards impacting the upper receiver causing accelerated wear and damage to the upper receiver. The existing systems have offered no meaningful solution to the carrier tilt issue or the resulting damage.

6) A simplified gas system that runs reliably without ever needing adjustments is achieved by allowing the full complement of discharge gas from the barrel gas port into the system and then controlling the expulsion of gas at the exhaust ports located on either side of the piston cylinder. The discharge gases are regulated at the exhaust ports by the piston's travel within the piston cylinder. The piston completely occludes the exhaust ports when fully in battery and upon firing the rifle the piston is actuated by the discharge gases thus moving breechward beyond the exhaust ports there by allowing the expulsion of the discharge gas. Once the discharge gas is fully expelled, the piston is returned to battery by the return spring once again occluding the exhaust ports for subsequent firing. This is a continuous cycle that is self regulating requiring no adjustment to the gas system. The existing systems are equipped with various types of gas regulators requiring the user to select the appropriate setting base on the ammunition selected. As noted above the present invention requires no such adjustments.

BRIEF DESCRIPTION OF THE DRAWINGS

Various embodiments of the presently disclosed gas piston conversion system are disclosed herein with reference to the drawings wherein.

DETAIL DESCRIPTION OF EMBODIMENTS

Figure 1:
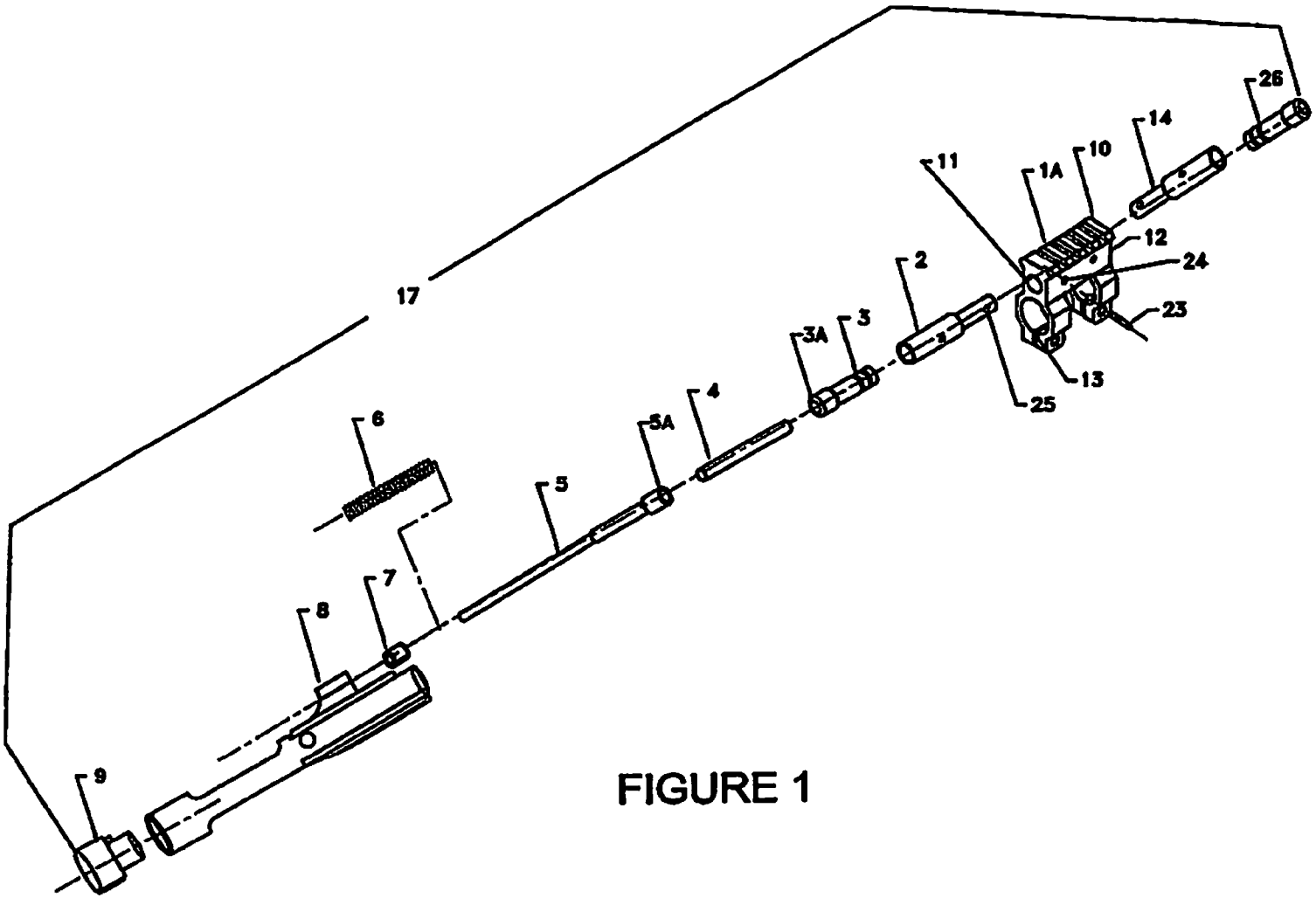
FIG. 1 is an exploded view in perspective of the presently disclosed convertible gas piston conversion system with a Picatinny rail type gas block, an AR-10 piston cylinder bore and AR-10 piston cylinder.

Embodiments of the presently disclosed convertible gas piston conversion system will now be described in detail with reference to the drawings wherein like reference numerals designate identical or corresponding elements in each of the several views.

The detailed description set forth below in connection with the appended drawings is intended as a description of selected embodiments of the disclosure and is not intended to represent the only forms in which the present embodiments may be constructed and/or utilized. The description sets forth the functions and the sequence of steps for constructing and operating the selected embodiments. However, it is to be understood that the same or equivalent functions and sequences may be accomplished by different embodiments that are also intended to be encompassed within the spirit and scope of this disclosure.

Figure 2:
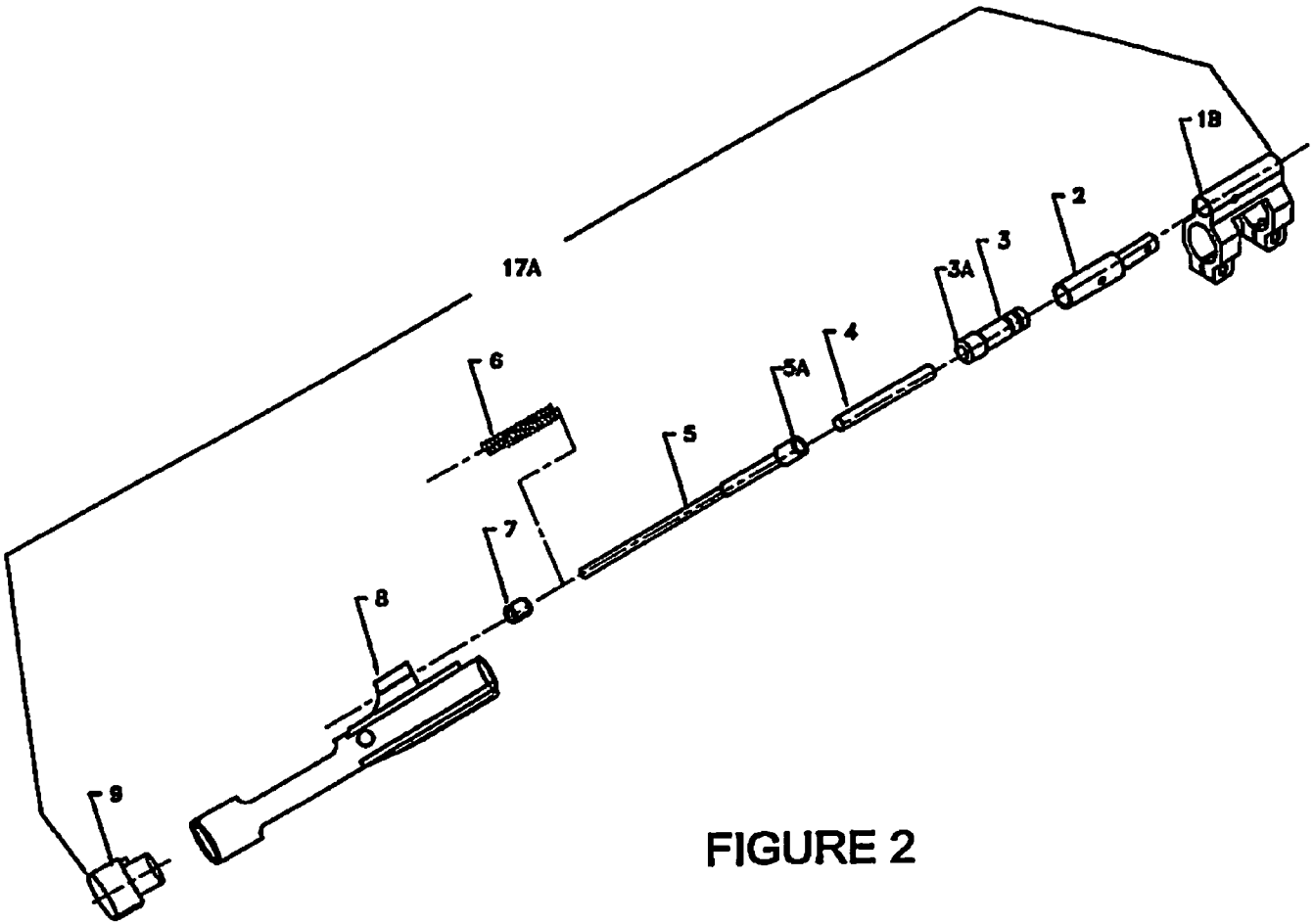
FIG. 2 is an exploded view in perspective of the presently disclosed convertible gas piston conversion system with a low profile gas block.
Figure 3:
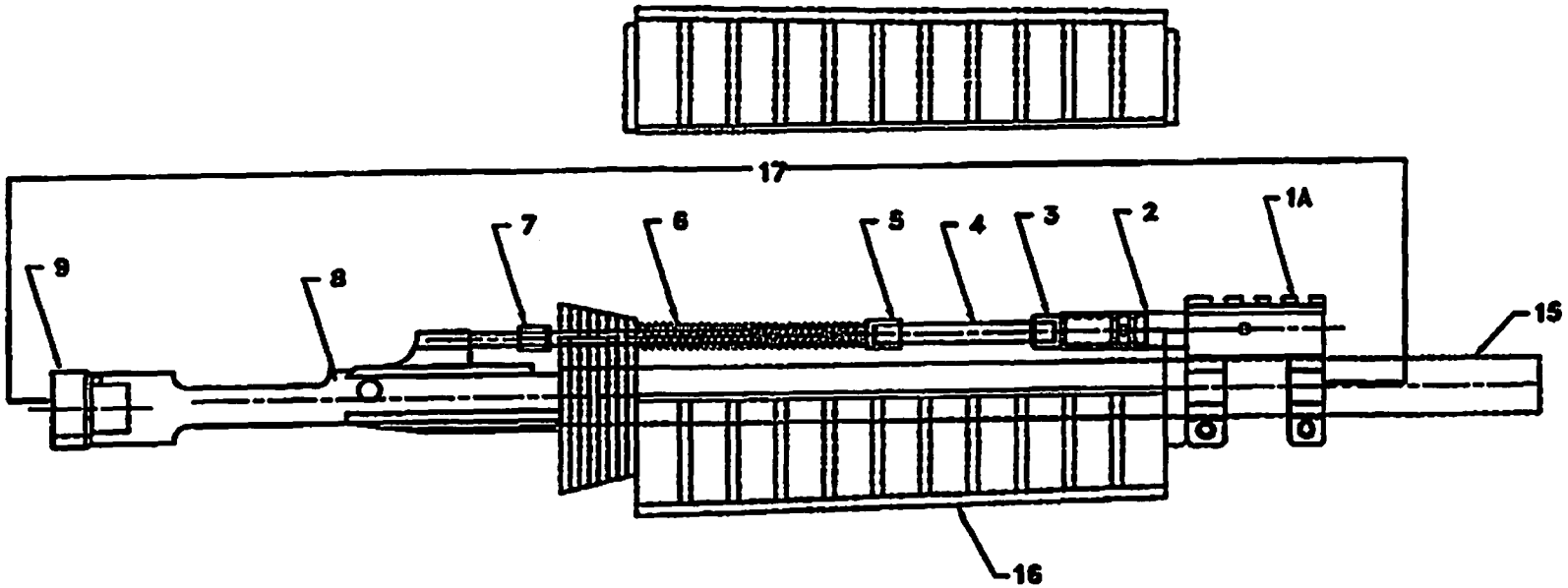
FIG. 3 is a side view of the convertible gas piston conversion system shown in FIG. 1 as it would be installed on a rifle.

Exemplary embodiments of the present disclosure are shown in FIGS. 1-7. Looking first at FIGS. 1 and 3, the convertible gas piston conversion system (17) is shown in an exploded view, with dashed lines indicating the order and way of assembly. The primary parts of the conversion system 17 include a Picatinny-type gas block (1A), a piston cylinder (2), a piston (3), a connecting link (4), an op-rod (5), a return spring (6), a bushing (7), a one bolt carrier (8), and an anti-wear/anti tilt carrier buffer device (9). In an alternative embodiment shown in FIG. 2, the gas block (1A) can be replaced by a low profile gas block (1B) which will be discussed in further detail herein below. The gas block (1A) forms a rail mounting surface (10) on a top surface of gas block (1A) for attaching accessories, e.g., lasers, sights, etc. There are three bores through the gas block (1A) including, an AR-15 piston cylinder bore (11), an AR-10 piston cylinder bore (12), and a barrel bore (13). The AR-15 piston cylinder bore (11) is configured to receive the AR-15 piston cylinder (2) and the AR-10 piston cylinder bore (12) is configured to receive the AR-10 piston cylinder (14). Since the Picatinny-type gas block (1A) has both an AR-15 piston cylinder bore (11) and an AR-10 piston cylinder bore (12), gas block (1A) is compatible with both the AR-15 rifle and the AR-10 rifle. The barrel bore (13) is configured to receive a barrel of a rifle (15) as shown in FIG. 3. The piston cylinder (2) or (14) defines a bore which is configured to slidably receive a piston (3). The piston (3) or (26) defines a bore (3A) which is configured to receive one end of the connecting link (4). The connecting link (4) is configured to be received within bore (3A) of the piston (3) on one end and to be received within a bore (5A) defined by the op-rod (5) on its other end. The op-rod (5) is configured to extend through a return spring (6), and bushing (7). As shown, return spring (6) can be a coil spring in compression. Alternatively, other spring types may be used as a return spring. The bolt carrier (8) is configured to receive the anti wear/anti tilt carrier buffer (9).

FIG. 3 is an illustration of the convertible gas piston conversion system (17) in an assembled state absent a rifle. FIG. 3 clearly indicates the order and arrangement of parts that makeup the convertible gas piston conversion system as it would be assembled on a rifle.

Figure 4:
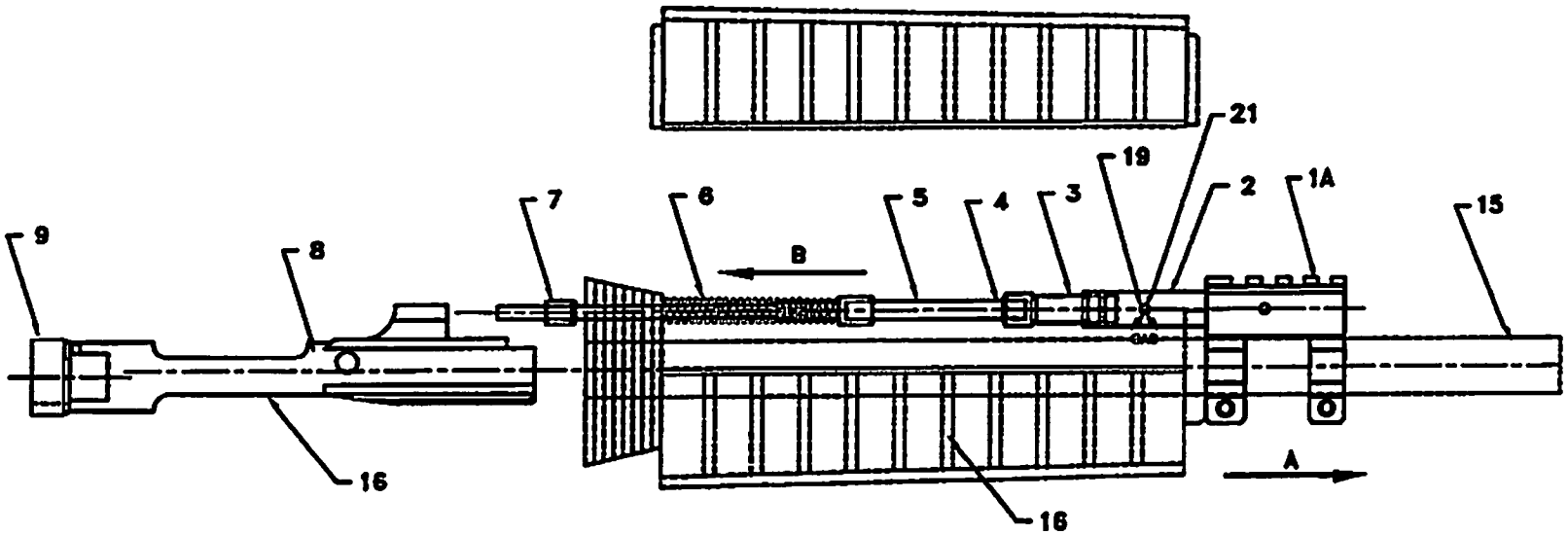
FIG. 4 is a side view of the convertible gas piston conversion system shown in FIG. 1 with the system in the actuated condition.
Figure 5:
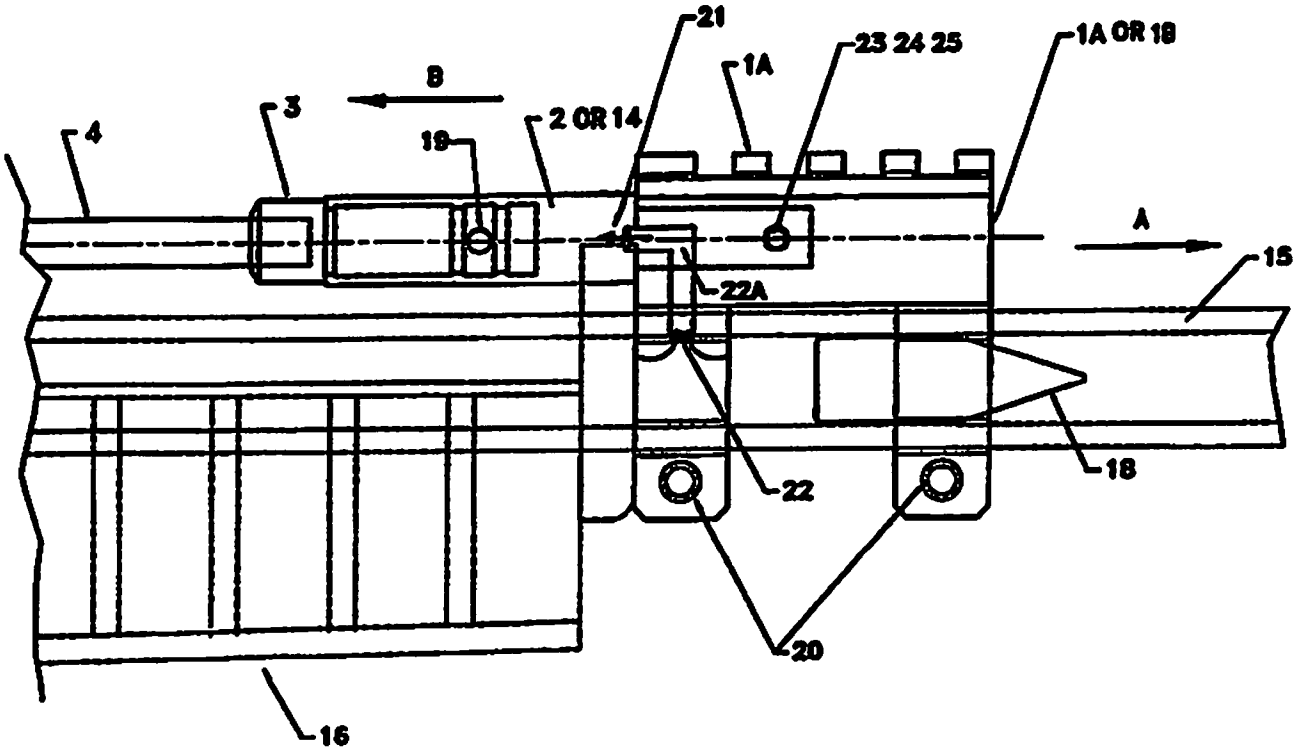
FIG. 5 is a side view of the convertible gas piston conversion system illustrating internal details showing how the gas system operates when in use and further illustrates how the system is secured together and attached to the rifle.

Referring to FIGS. 4 and 5, a barrel (15) of a rifle (not shown) defines a gas port aperture (22) which communicates with piston cylinder passage (2). Piston cylinder (2) also includes an exhaust port (19) which communicates with the atmosphere.

As discussed above, gas block (1A) includes barrel bore (13) which is dimensioned to receive barrel (15) of a rifle (not shown). Clamping screws (20) are provided to fixedly secure gas block (1A) to barrel 15. See FIG. 5. In addition, gas block (1A) defines a retaining pin hole (24) which is aligned with a retaining pin hole (25) formed in piston cylinder (2). A retaining pin (23) is dimensioned to be received through retaining pin holes (24) and (25) to secure piston cylinder (2) to gas block (1A).

Referring to FIGS. 4 and 5, when a round is fired, a bullet (18) is propelled by discharge gas (21) muzzleward in the direction indicated by arrow "A". When the bullet (18) passes the gas port aperture (22), a portion of discharge gas (21) is directed through gas port aperture (22) and into the piston cylinder passage (22A). As the discharge gas (21) enters the piston cylinder (2), the gas exerts a force upon the bottom of the piston (3) and drives the piston (3), connecting link (4), and op-rod (5) breechward or in the direction indicated by arrow "B". As op-rod (5) moves breechward, return spring (6) is compressed.

Turning now to FIG. 4, the piston (3), connecting link (4), and op rod (5) continue to be driven breechward by discharge gases (21) until the piston (3) passes the exhaust port (19). When the piston (3) passes exhaust port (19), the discharged gas (21) from within the piston cylinder (2) is expelled into the atmosphere through the exhaust port (19) thereby depressurizing the piston cylinder (2). Once the piston cylinder (2) depressurizes, the return spring (6) forces the piston (3) muzzleward returning the piston (3) fully into battery. With the piston (3) in full battery, the system is in a state of readiness for subsequent firing.

Figure 6:
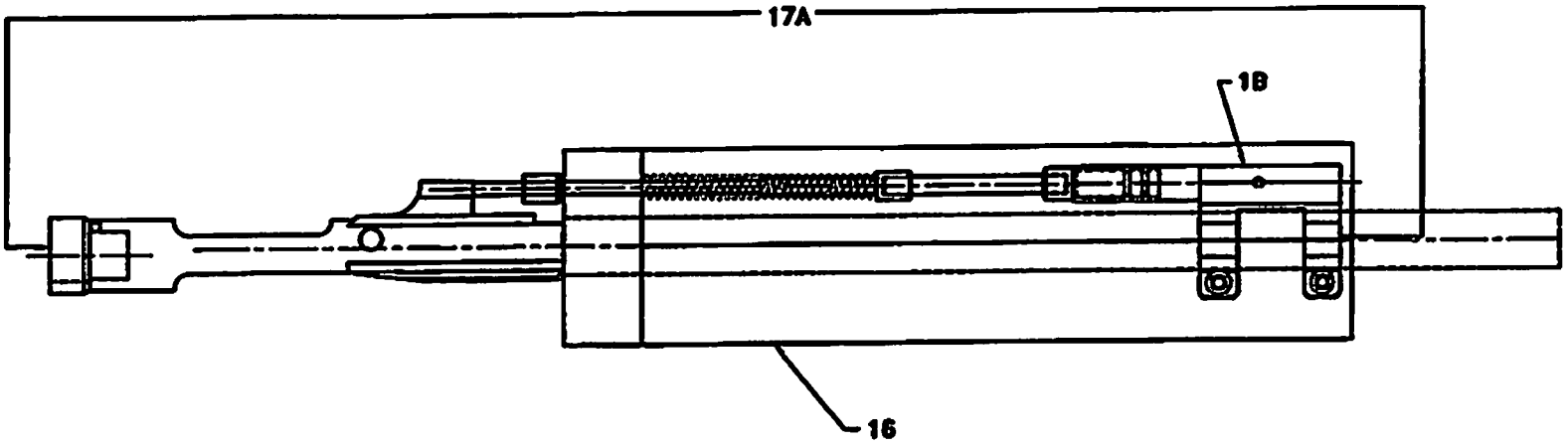
FIG. 6 is a side view of the convertible gas piston conversion system shown in FIG. 2 illustrating the system fully concealed by the rifles hand guard when utilizing the low profile gas block.

Referring to FIGS. 2 and 6, the convertible gas piston conversion system (17A) functions substantially as described above with respect to conversion system (17). As shown in FIG. 6 using the low profile gas block (1B), the conversion system 17A is fully concealed under a rifle's hand guard (16).

Figure 7:
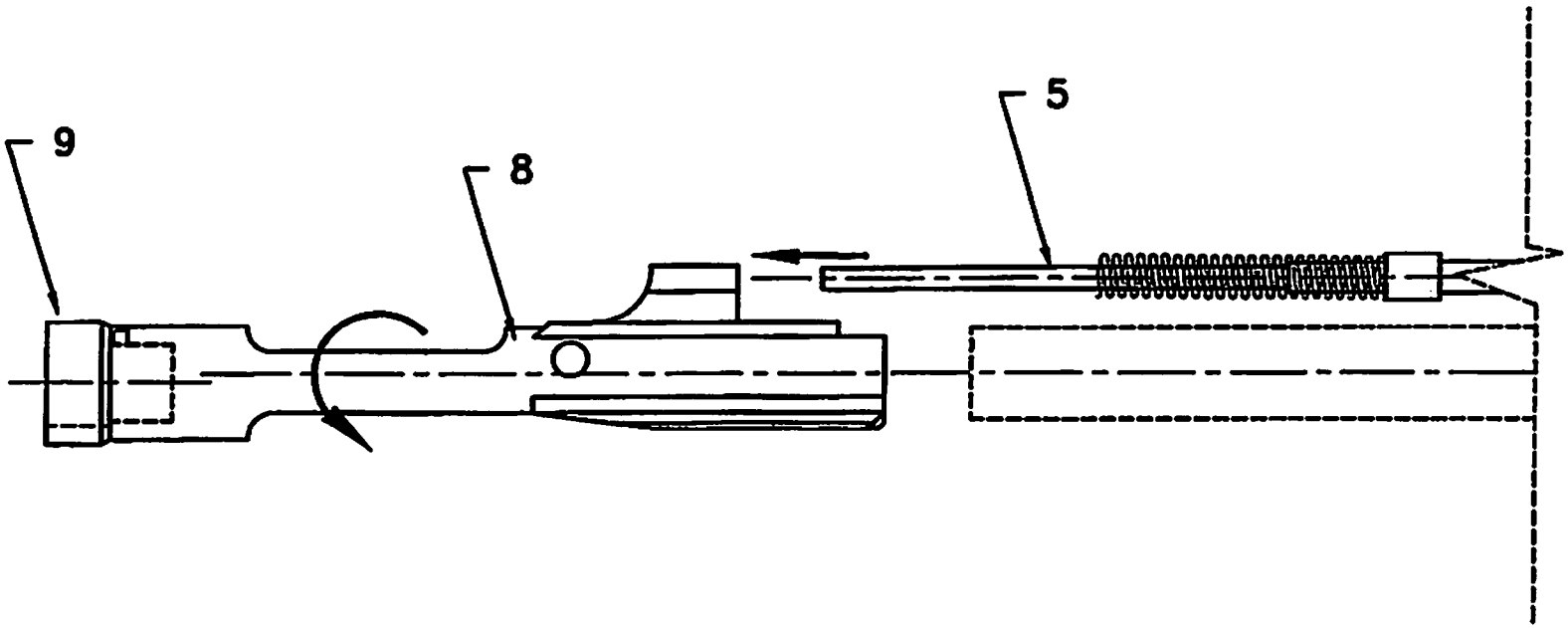
FIG. 7 is an illustration of the forces created during firing of a rifle that cause excessive wear and damage to the buffer tube and upper receiver that are mitigated by the presently disclosed anti-wear carrier buffer.
Figure 9:
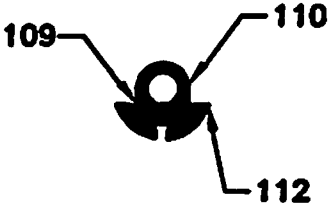
FIG. 9 is a rear view of the anti-wear buffer device shown in FIG. 8.
Figure 8:
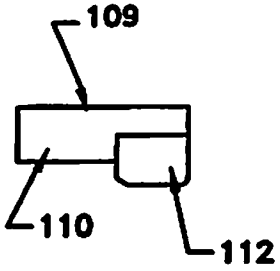
FIG. 8 is a side view of an alternative embodiment of the presently disclosed anti-wear carrier buffer or buffer device.
Figure 12:
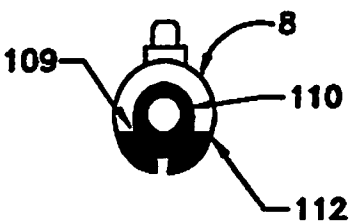
FIG. 12 is a rear view of the anti-wear buffer device and bolt carrier shown in FIG. 11.
Figure 11:
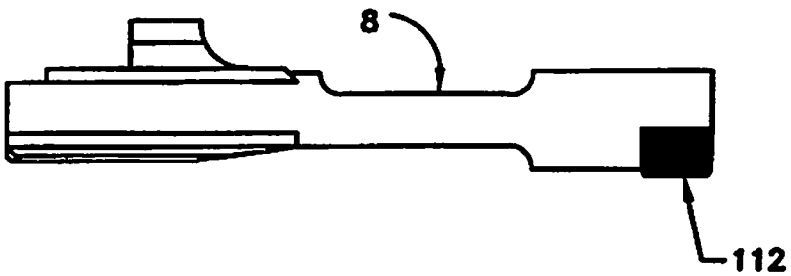
FIG. 11 is a side view of the anti-wear buffer device and bolt carrier shown in FIG. 10.
Figure 10:
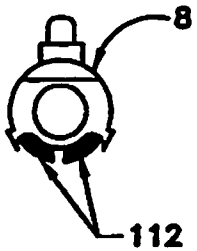
FIG. 10 is a front view of the anti-wear buffer device shown in FIG. 8 mounted to the bolt carrier.
Figures 13A, 13B, 13C, 13D:
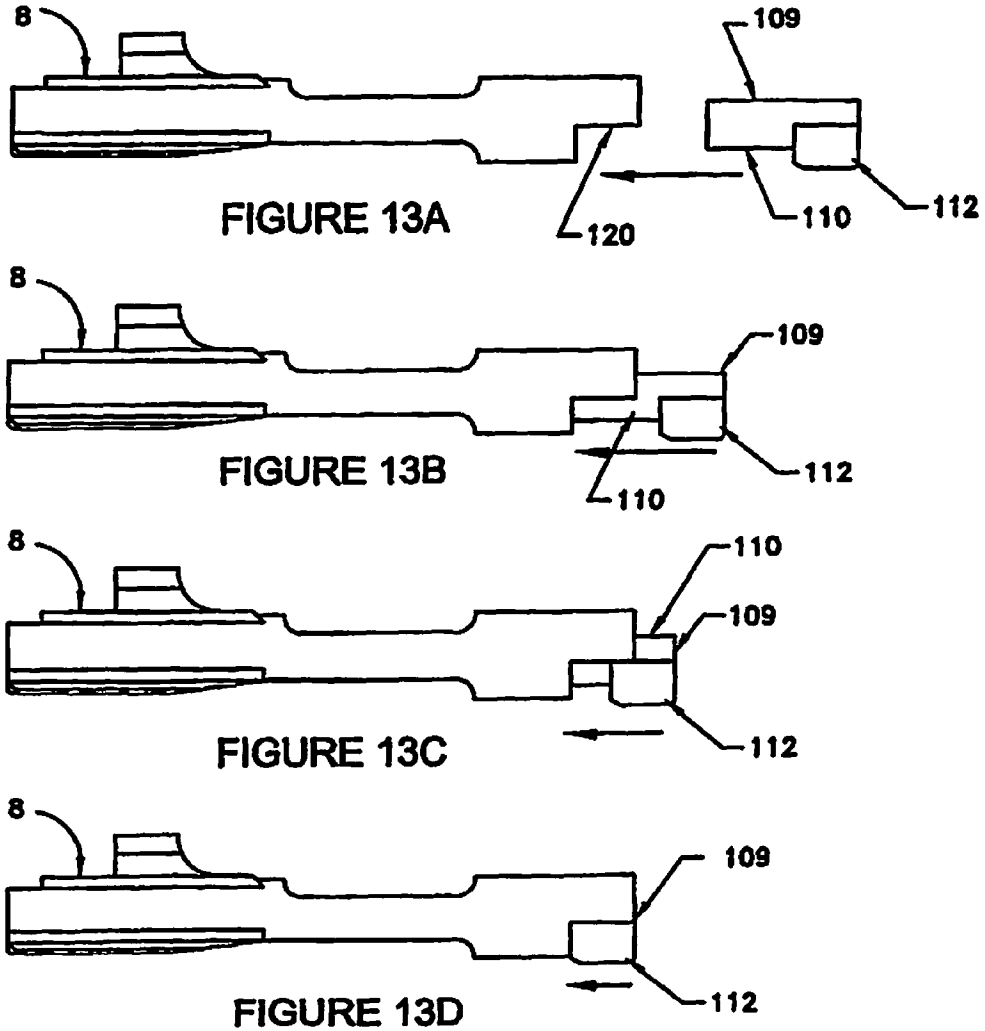
FIGS. 13A-13D are side views of the anti-wear buffer device and bolt carrier during various stages of assembly.

FIG. 7 illustrates how torque is applied to the bolt carrier (8) by the off axis transfer of energy from the op-rod (5) to the bolt carrier (8). As this torque is applied to the bolt carrier (8), the anti-wear carrier buffer (9) fitted within the bolt carrier (8) prevents carrier tilt and the excessive wear and damage associated with piston operated AR-15 and AR-10 rifle systems.

As discussed above, the presently disclosed conversion systems (17) and (17A) including gas block (1A) and low profile gas block (1B), respectively, are configured for use with AR-15 and AR-10 rifles and related rifle platforms. Each of the systems simplifies assembly and disassembly of the system to and from a rifle. In current systems, assembly and disassembly is accomplished by removing or installing the system through the gas block. Because components of current conversion systems suitable for use with the AR-15 rifle are dimensionally different from the components suitable for use with the AR-10 rifle, a single conversion system is not suitable for use with both rifles. In the presently disclosed systems, the system can be easily disassembled by manually advancing op-rod (5) to compress return spring (6) and then removing the connecting link (4) from between the piston (3) and the op-rod (5). Thereafter, the components, i.e., piston (3), op-rod (5), and spring (6) can be removed from the rifle. Because the components do not have to pass through the gas block, the presently disclosed systems can be used with both the AR-10 and AR-15 rifle platforms by simply using the appropriate piston cylinder (2) or (14), piston (3) or (26) and properly positioning the gas block such that the selected cylinder bore (11) or (12) faces the bolt carrier (8). Furthermore, the system may be provided in kit form with various length connecting links to make it compatible with the various length gas systems that makeup the AR-15 and AR-10 rifles and related rifle platforms.

As shown in FIG. 1, the anti-tilt/anti-wear buffer device (9) includes a stepped cylindrical member which includes a smaller diameter portion which is press-fit into the rear end of the bolt carrier (8) and a larger diameter portion which is positioned to slidably engage the buffer tube. In an alternative embodiment shown in FIGS. 8-12, the buffer device (109) includes a substantially cylindrical body (110) including a pair of rearwardly positioned radially extending wings (112) which extend slightly below the lower surface of the bolt carrier (8) when buffer device (109) is secured to the rear end of the bolt carrier (8). Alternately, one or more wings may be provided. As discussed above, buffer device (109) may be formed from a polymer type material. In one embodiment, the buffer device (109) is formed from a high performance polyethylene material that has substantially improved abrasion resistant characteristics as compared to carbon steel, e.g., fifteen times the abrasion resistance as compared to carbon steel, yet is soft enough to impact the buffer tube without causing excessive wear.

Referring to FIGS. 13A-13D, the buffer device (109) may be press fit into the rear end of the bolt carrier (8). More specifically, the cylindrical body (110) is dimensioned to frictionally engage inner surfaces of the bolt carrier (8) as the buffer device (109) is pressed into the rear end of the bolt carrier (8). See FIGS. 13A-13C. When the buffer device (109) is fully inserted into bolt carrier (8), wings (112) are positioned within a cutout (120) (FIG. 13A) formed in a rear end of the bolt carrier (8).

It is envisioned that the buffer device may assume a variety of configurations, evident to those of ordinary skill in the art, not specifically shown herein. It is also envisioned that the buffer device may be secured to the bolt carrier using a variety of different fastening techniques, e.g., pins, interlocking structure, crimping, etc.

Figure 14:
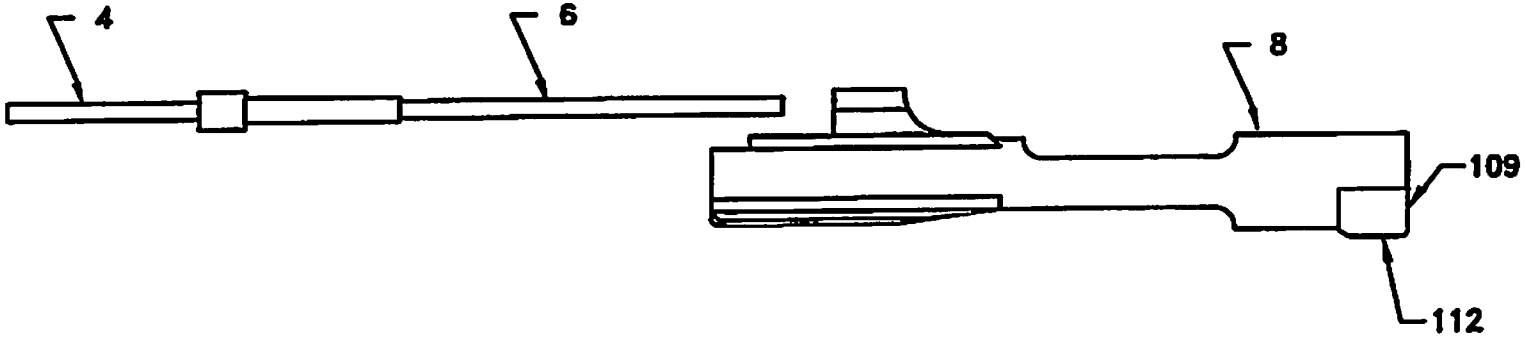
FIG. 14 is a side view of the operation rod and bolt carrier including the presently disclosed anti-wear buffer device.

FIG. 14 illustrates the op-rod (6) and bolt carrier (8) including the buffer device (109). As can be seen, the buffer device (109) is positioned to minimize wear and tilting of the bolt carrier (8) resulting from off-axis force applied by the op-rod (6) to the bolt carrier (8).

Figure 15:
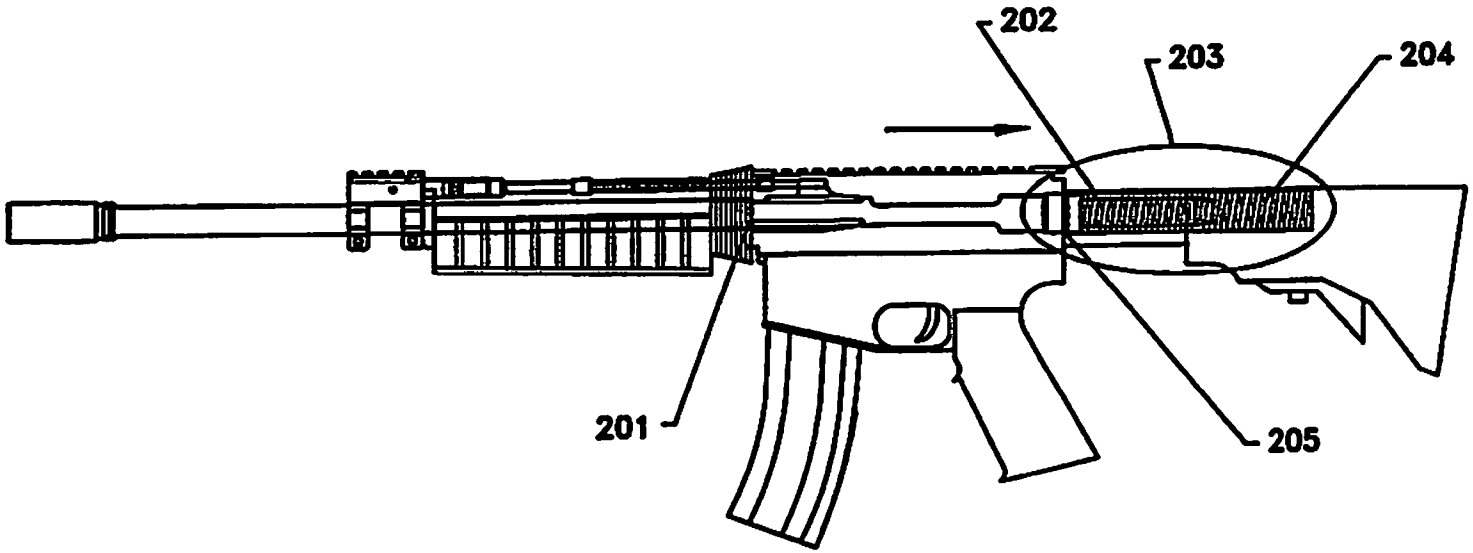
FIGS. 15-17 illustrate operational views of a bolt carrier of an M16, AR-15, AR-10 or variant rifle platform.

FIG. 15 is an illustration showing how the bolt carrier functions in the M16, AR-15, AR-10 or a variant rifle platform. Reference number 201 shows the bolt carrier starting rearward after the rifle has been discharged. Reference number 202 demonstrates how the recoil buffer under spring pressure is held against the bolt carrier to buffer the rifles recoil and return the bolt carrier back into battery with a fresh cartridge for subsequent firing of the rifle. Reference number 203 shows how the recoil buffer, spring and buffer tube are arranged inside the rifles butt stock. Reference number 204 points to the recoil spring being compressed by the bolt carrier's rearward movement created by the gas piston systems op-rod striking the bolt carrier's impingement lug. Reference number 205 points to the area where buffer tube damage results from the off axis transfer of energy from the gas piston systems op-rod to the bolt carrier impingement lug, thus creating a significant downward force that causes a wearing away of the buffer tube, where the hardened steel carrier contacts the aluminum buffer tube.

Figure 16:
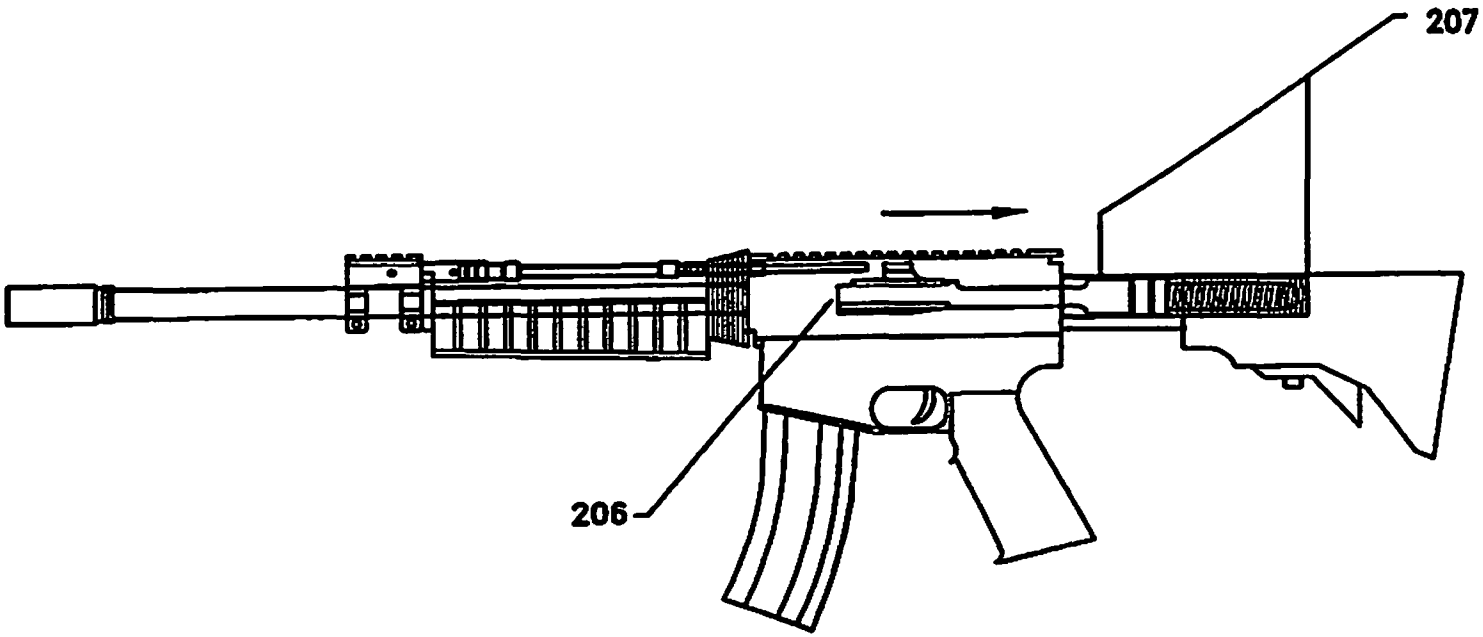

In FIG. 16, reference number 206 shows the bolt carrier nearing the end of its rearward motion. Reference number 207 illustrates how the bolt carrier, buffer, and buffer spring work in unison, never breaking contact throughout the rifle systems operation.

Figure 17:
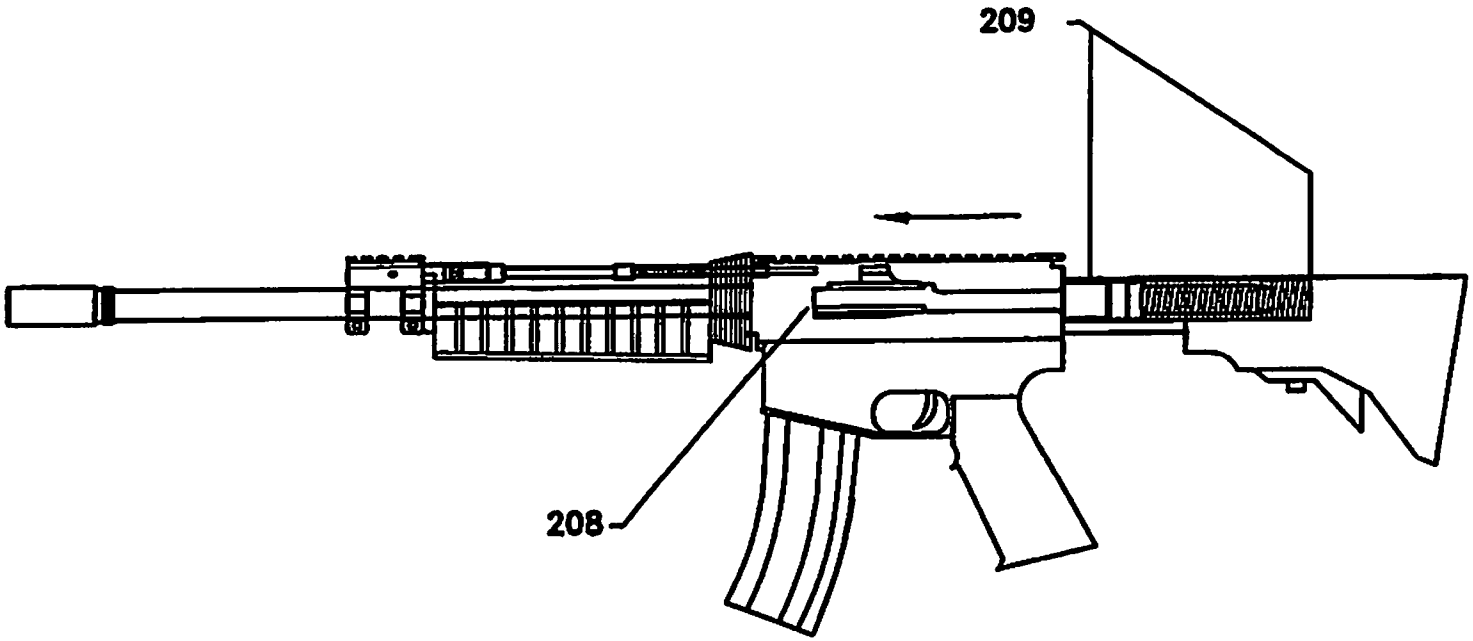

In FIG. 17, reference numbers 208 and 209 demonstrate how the bolt carrier is moved forward by the energy contained in the compressed recoil spring, thus returning the rifle to the closed bolt position.

It will be understood that various modifications may be made to the embodiments disclosed herein. For example, as discussed above, the buffer device may assume a variety of configurations and be secured to the bolt carrier using a variety of different securement techniques. Therefore, the above description should not be construed as limiting, but merely as exemplifications of the disclosed embodiments. Those skilled in the art will envision other modifications within the scope and spirit of the claims appended hereto.

What is claimed is:

1. A bolt carrier assembly for rifle platforms comprising:

a bolt carrier body formed of a first material having a forward end and a rear end; and a buffer device fitted to the rear end of the bolt carrier body, the buffer device being formed of a second material that is different from the first material, the second material being a polymer material.

2. The bolt carrier assembly according to claim 1, wherein the polymer material is a polyethylene material.

3. The bolt carrier assembly according to claim 1, wherein the buffer device is dimensioned to be press-fit into the rear end of the bolt carrier body.

4. The bolt carrier assembly according to claim 1, wherein the buffer device includes a stepped cylindrical member having a smaller diameter portion configured to be received within the bolt carrier body and a larger diameter portion configured to engage an inner surface of a rifle.

5. The bolt carrier assembly according to claim 1, wherein the buffer device includes a substantially cylindrical body portion and one or more radially extending wings.

6. The bolt carrier assembly according to claim 1, wherein the bolt carrier body is formed from steel.

7. The bolt carrier assembly according to claim 6, wherein the bolt carrier body is formed from hardened steel.

8. The bolt carrier assembly according to claim 1, wherein the polymer material is a wear resistant material.

9. The bolt carrier assembly according to claim 1, wherein the buffer device includes a substantially cylindrical body portion and one or more radially extending wings.

10. The bolt carrier assembly according to claim 1, wherein the polymer material is a wear resistant material.

11. A bolt carrier assembly for rifle platforms comprising:

a bolt carrier body formed from steel and having a forward end and a rear end;

a buffer device secured to the rear end of the bolt carrier body, the buffer device being formed of a non-metallic material.

12. The bolt carrier assembly according to claim 11, wherein the non-metallic material is a polymer.

13. The bolt carrier assembly according to claim 11, wherein the bolt carrier body is formed from hardened steel and the non-metallic material is a polyethylene.

14. The bolt carrier assembly according to claim 11, wherein the buffer device includes a stepped cylindrical member having a smaller diameter portion configured to be received within the bolt carrier body and a larger diameter portion configured to engage an inner surface of a rifle.

15. The bolt carrier assembly according to claim 11, wherein the buffer device includes a substantially cylindrical body portion and one or more radially extending wings.

16. The bolt carrier assembly according to claim 11, wherein the non-metallic material is a wear resistant material.

17. A bolt carrier assembly for rifle platforms comprising:

a bolt carrier body and a buffer device, the bolt carrier body being formed of a first material and having a forward end and a rear end, the rear end being configured to receive the buffer device, the buffer device being formed from a second material that is different from the first material, wherein the second material is a polymer material.

18. The bolt carrier assembly according to claim 17, wherein the bolt carrier body is formed from steel.

19. A bolt carrier assembly according to claim 18, wherein the bolt carrier body is formed from hardened steel.

20. The bolt carrier assembly according to claim 18, wherein the buffer device includes a stepped cylindrical member having a smaller diameter portion configured to be received within the bolt carrier body and a larger diameter portion configured to engage an inner surface of a rifle.

* * * * *